US011976649B2

(12) United States Patent
Wang

(10) Patent No.: US 11,976,649 B2
(45) Date of Patent: May 7, 2024

(54) AIR PUMP WITH EXTERNAL PRESSURE RELIEF VALVE

(71) Applicant: TangTring Seating Technology Inc., Guangdong (CN)

(72) Inventor: Zhi-Gang Wang, Guangdong (CN)

(73) Assignee: TANGTRING SEATING TECHNOLOGY INC., Guangdong (CN)

( * ) Notice: Subject to any disclaimer, the term of this patent is extended or adjusted under 35 U.S.C. 154(b) by 352 days.

(21) Appl. No.: 17/271,429

(22) PCT Filed: Nov. 15, 2018

(86) PCT No.: PCT/CN2018/115673
§ 371 (c)(1),
(2) Date: Feb. 25, 2021

(87) PCT Pub. No.: WO2020/097860
PCT Pub. Date: May 22, 2020

(65) Prior Publication Data

US 2021/0324848 A1 Oct. 21, 2021

(51) Int. Cl.
*F04B 49/24* (2006.01)
*F04B 39/10* (2006.01)
(Continued)

(52) U.S. Cl.
CPC ..... *F04B 49/24* (2013.01); *F04B 39/10* (2013.01); *F04B 39/1013* (2013.01);
(Continued)

(58) Field of Classification Search
CPC .... F04B 49/24; F04B 39/1013; F04B 45/043; F04B 45/04; F04B 43/026; F04B 43/0081
See application file for complete search history.

(56) References Cited

U.S. PATENT DOCUMENTS 4,705,461 A * 11/1987 Clements ..... F04B 43/067 417/387
5,800,136 A * 9/1998 Kurth ..... F04B 43/026 417/311
(Continued)

FOREIGN PATENT DOCUMENTS

CN 203717289 U 7/2014
CN 205478213 U 8/2016
(Continued)

OTHER PUBLICATIONS

Machine Translation of CN 206957901.*
Machine Translation of CN 203717289.*

*Primary Examiner* — Christopher S Bobish
(74) *Attorney, Agent, or Firm* — MUNCY, GEISSLER, OLDS & LOWE, PC

(57) ABSTRACT

An air pump with an external pressure release valve includes an air pump body, a flow channel seat and at least one air valve. The air pump body comprises a driving motor and at least one air bag group for generating air flow. The flow channel seat includes an airflow channel and a pressure release channel communicated with the airflow channel and extending to any side wall surface of the flow channel seat. The side wall surface includes an installation hole of an outlet of the pressure release channel. The installation hole includes a pressure release assembly arranged inside the pressure release channel. Because the air pump includes the pressure release channel, and the pressure release channel extends to any side wall surface, the air pump is respectively connected with different objects to be inflated, meanwhile, an assembler can more easily adjust the output air pressure of each air pump.

6 Claims, 8 Drawing Sheets

(51) Int. Cl.

| | |
|---|---|
| ***F04B 39/12*** | (2006.01) |
| ***F04B 43/00*** | (2006.01) |
| ***F04B 43/02*** | (2006.01) |
| ***F04B 45/04*** | (2006.01) |

(52) U.S. Cl.
CPC ..... *F04B 39/12* (2013.01); *F04B 43/0081* (2013.01); *F04B 43/026* (2013.01); *F04B 45/04* (2013.01); *F04B 45/043* (2013.01)

(56) References Cited

U.S. PATENT DOCUMENTS

| | | | | |
|---|---|---|---|---|
| 9,028,224 | B2 * | 5/2015 | Headley | F04B 43/0736 137/625.25 |
| 9,920,753 | B2 * | 3/2018 | Douglas | F04B 45/047 |
| 10,458,402 | B2 * | 10/2019 | Yan | F04B 9/045 |
| 10,711,775 | B2 * | 7/2020 | Hashimoto | F04B 53/123 |
| 11,221,005 | B2 * | 1/2022 | Chang | F04B 49/035 |
| 2014/0161654 | A1 * | 6/2014 | Dorfler | F04B 49/22 417/443 |
| 2020/0011320 | A1 * | 1/2020 | Cipala | F16K 1/301 |

FOREIGN PATENT DOCUMENTS

| | | | |
|---|---|---|---|
| CN | 102161321 | B | 3/2017 |
| CN | 206257023 | U | 6/2017 |
| CN | 206290397 | U | 6/2017 |
| CN | 206409691 | U | 8/2017 |
| CN | 206957901 | U | 2/2018 |
| CN | 110145461 | A | 8/2019 |
| JP | 2016217334 | A | 12/2016 |

* cited by examiner

AIR PUMP WITH EXTERNAL PRESSURE RELIEF VALVE

FIELD OF THE INVENTION

The invention relates to an air pump with an external pressure relief valve; in particular to an air pump with a pressure relief channel extended to any sidewall surface of a flow passage base for a user adjust the pressure of the air pump conveniently.

BACKGROUND OF THE INVENTION

The automobile electronics industry nowadays provides an air pump with a combined solenoid valve to reduce the volume, due to a limited space for assembly seats. In particular, the combined solenoid valve includes at least one solenoid valve and at least one back pressure valve corresponding to the solenoid valve. The air pump is provided with a related art of the combined solenoid valve as disclosed in Chinese Patent No. 102161321B and so on. The air pump includes at least one fluid cavity and a valve assembly in communication with the at least one fluid cavity, the valve assembly including a back pressure valve and a solenoid valve. Although said patent disclosed that the air pump incorporates the back pressure valve and the solenoid valve, an additional structure is not required to perform air pressure control on the air pump, and excessive volume of the air pump is avoided. Nevertheless, functions of to-be-inflated objects corresponding to the air pump are different, thus the invention additionally provides a pressure relief channel and a pressure relief assembly for assembly personnel to conveniently adjust an outlet pressure of the air pump in the assembly process so as to correspond to the air pressure required by any one of to-be-inflated objects.

SUMMARY OF THE INVENTION

The main purpose of the present invention is to solve the problem that although a conventional air pump is provided with a solenoid valve and a check valve to control airflow, excessive saturation of an object to be inflated cannot be avoided.

In order to achieve the object, the invention provides an air pump with an external pressure relief valve, comprising an air pump body, a flow passage base and at least two air valves. The flow passage base is arranged on the air pump body. The air pump body comprises a driving motor and at least one air bag set which is actuated by the driving motor and generates airflow. The flow passage base comprises an airflow channel and a pressure relief channel. The airflow channel receives the output airflow of the air bag set and is provided with at least two airflow outlets. The pressure relief channel is communicated with the airflow channel and extends to any sidewall surface of the flow passage base, wherein a mounting hole is formed on the sidewall surface to communicate with the pressure relief channel, and a pressure relief assembly is placed into the pressure relief channel through the mounting hole. The at least two air valves are arranged on the flow passage base and respectively communicated with the at least two airflow outlets to receive the output airflow.

In an embodiment, from the airflow channel to the mounting hole, the pressure relief channel includes an arrangement section, a movable section and a mounting section with different inner diameters separately, wherein the inner diameters in an ascending order is the arrangement section the movable section, and the mounting section.

In an embodiment, the pressure relief assembly comprises a fixed member provided in the mounting section and a movable member provided in the movable section to abut against the fixed member with an elastic member, and an outer diameter of the movable member is greater than the inner diameter of the arrangement section and less than the inner diameter of the mounting section, and wherein based on the elastic member subjected to a pressure change in the pressure relief channel, the movable member includes a closed position for closing the arrangement section, and a pressure relief position for discharging an airflow in the airflow channel from the arrangement section to outside the mounting hole.

In an embodiment, an air lock is disposed between the movable member and the arrangement section for to prevent the outlet airflow from passing through.

In an embodiment, the fixed member includes an air vent communicating the mounting section with outside to discharge a pressure relief airflow outside.

In an embodiment, the flow passage base includes at least one first arrangement part positioned at one of the at least two airflow outlets to accommodate one of the at least two air valves.

In an embodiment, the flow passage base includes a control circuit board to provide electric signals to the driving motor and the at least two air valves and a second arrangement part to accommodate the control circuit board.

In an embodiment, the flow passage base includes a cover body covering one of the at least two air valves and the control circuit board, and the cover body is provided with at least one output hole assembling with one of the at least two air valves and a wiring hole assembling with the control circuit board.

According to the present invention, compared with conventional use, the invention has the following advantages that the air pump is provided with the pressure relief channel, which extends to any sidewall surface of the flow passage base. In addition, the mounting hole is formed on the sidewall surface for assembly personnel placing the pressure relief assembly through the mounting hole easily, and assembly personnel operating the pressure relief assembly to adjust the pressure of the air pump conveniently.

DETAILED DESCRIPTION OF THE PREFERRED EMBODIMENTS

The detailed description and technical contents of the present invention will now be described with reference to the drawings as follows.

Figure 1:
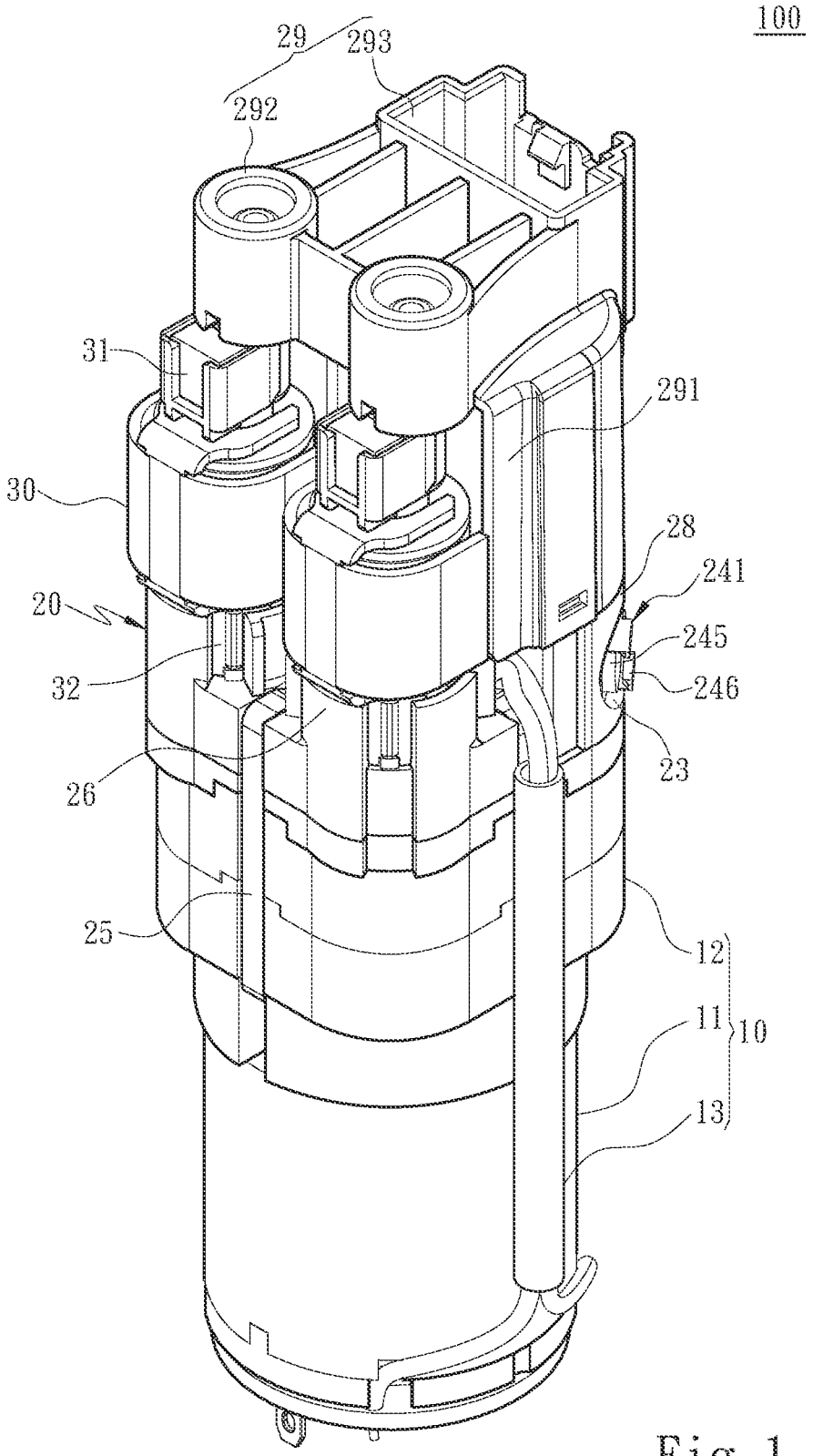
FIG. 1 is a schematic diagram of an embodiment of the present invention.
Figure 2:
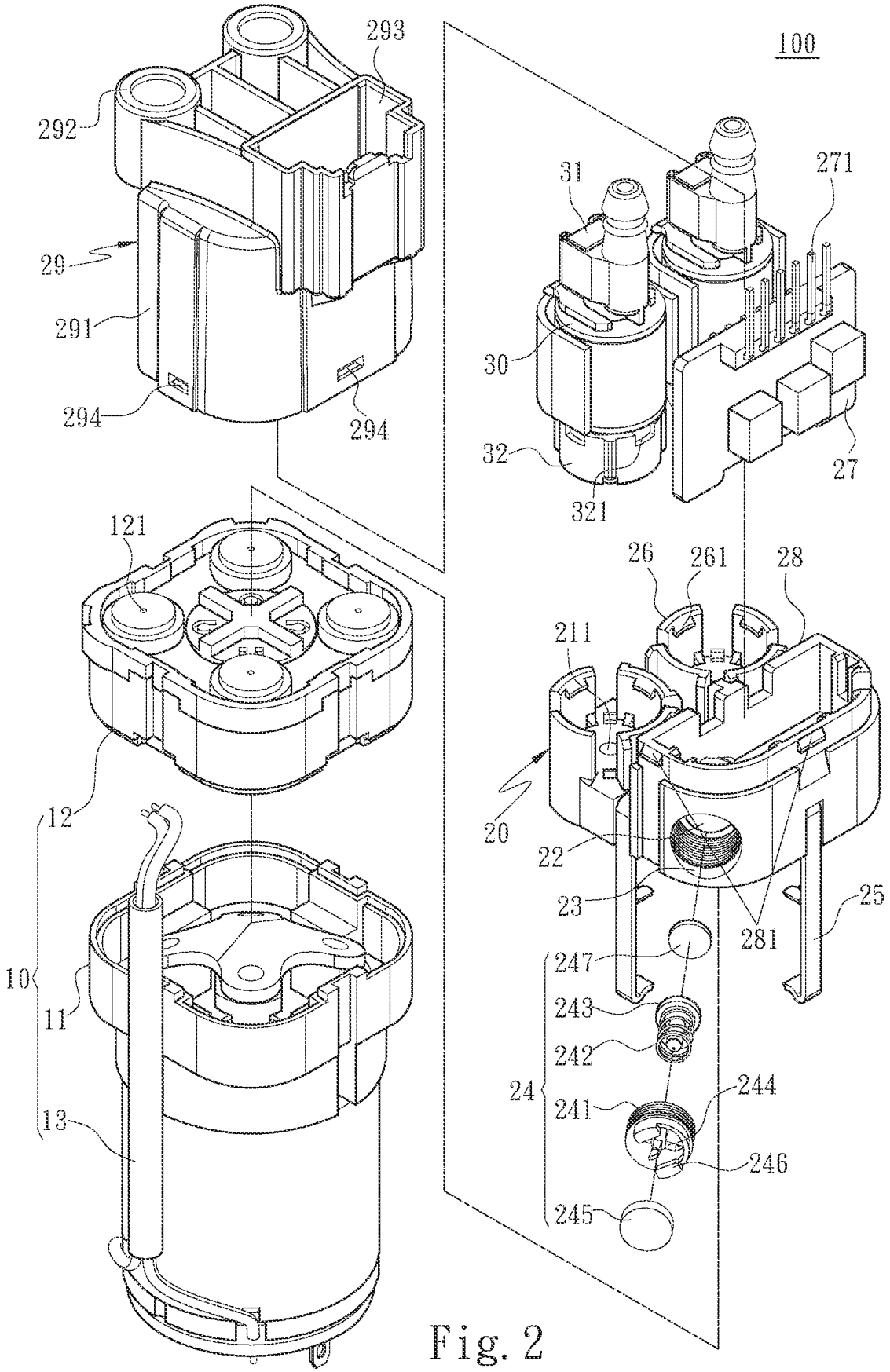
FIG. 2 is a first exploded perspective view of an embodiment of the present invention.
Figure 3:
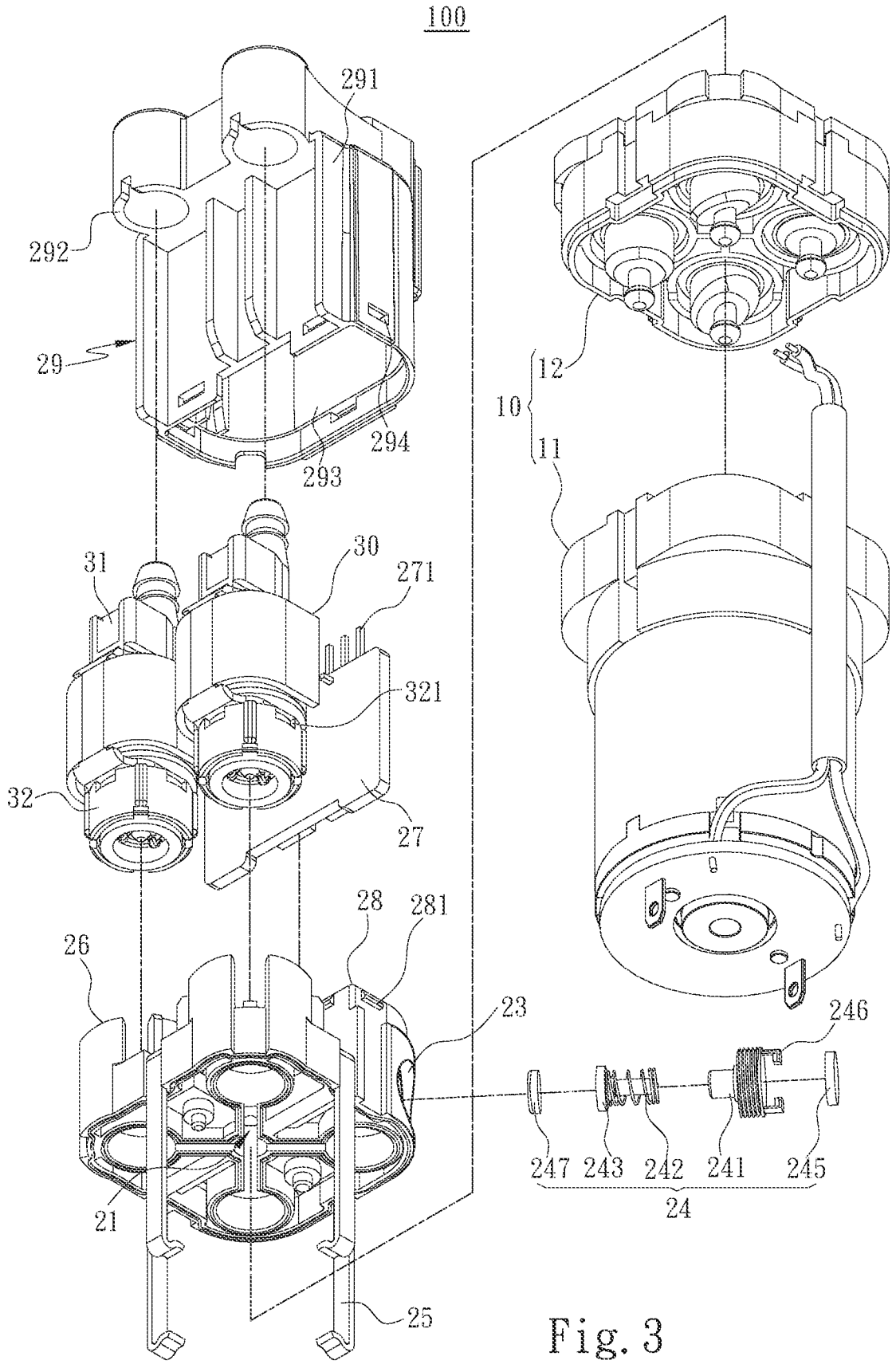
FIG. 3 is a second exploded perspective view of an embodiment of the present invention.

Referring to FIG. 1, FIG. 2 and FIG. 3, it provides an air pump 100 with an external pressure relief valve. The air pump 100 includes an air pump body 10, a flow passage base 20 provided on the air pump body 10, and at least one air valve 30 arranged on the flow passage base 20. Specifically, the air pump body 10 includes a driving motor 11 and at least one air bag set 12 actuated by the driving motor 11 to generate an output airflow. The air bag set 12 includes an exhaust hole 121 communicated with the air bag set 12 and outputs the output airflow therethrough. Embodiments of the driving motor 11 and the air bag set 12 are described with reference to the Chinese Utility Model Patent No. 206290397U, and the Chinese Patent Publication No. 110145461A filed by the applicant, which will not be described in detail herein. Further, the flow passage base 20 is provided with an airflow channel 21 for receiving the output airflow, and a pressure relief channel 22 communicated with the airflow channel 21 and extending to any sidewall surface of the flow passage base 20. In detail, referring to FIG. 2 and FIG. 3, one end of the airflow channel 21 is communicated with the exhaust hole 121, and the other end of the airflow channel 21 is provided with an airflow outlet 211 for discharging the output airflow. The pressure relief channel 22 is provided on the flow passage base 20; and further, in order to let the pressure relief channel 22 discharge the output airflow rapidly, the pressure relief channel 22 is arranged in the center of the airflow channel 21 and extended toward any direction where the flow passage base 20 is not provided with the airflow outlet 211. That is, the extended direction of the pressure relief channel 22 is adjusted according to use requirements, and is not limited thereto. In addition, in order for the pressure relief channel 22 to be exposed on the sidewall surface, a mounting hole 23 is formed on the sidewall surface to communicate with the pressure relief channel 22, and a pressure relief assembly 24 is placed into the pressure relief channel 22 through the mounting hole 23. Further, the at least one air valve 30 is mounted on the flow passage base 20 and communicated with the airflow outlet 211 for discharging the outlet airflow to inflate a to-be-inflated object.

Figure 4:
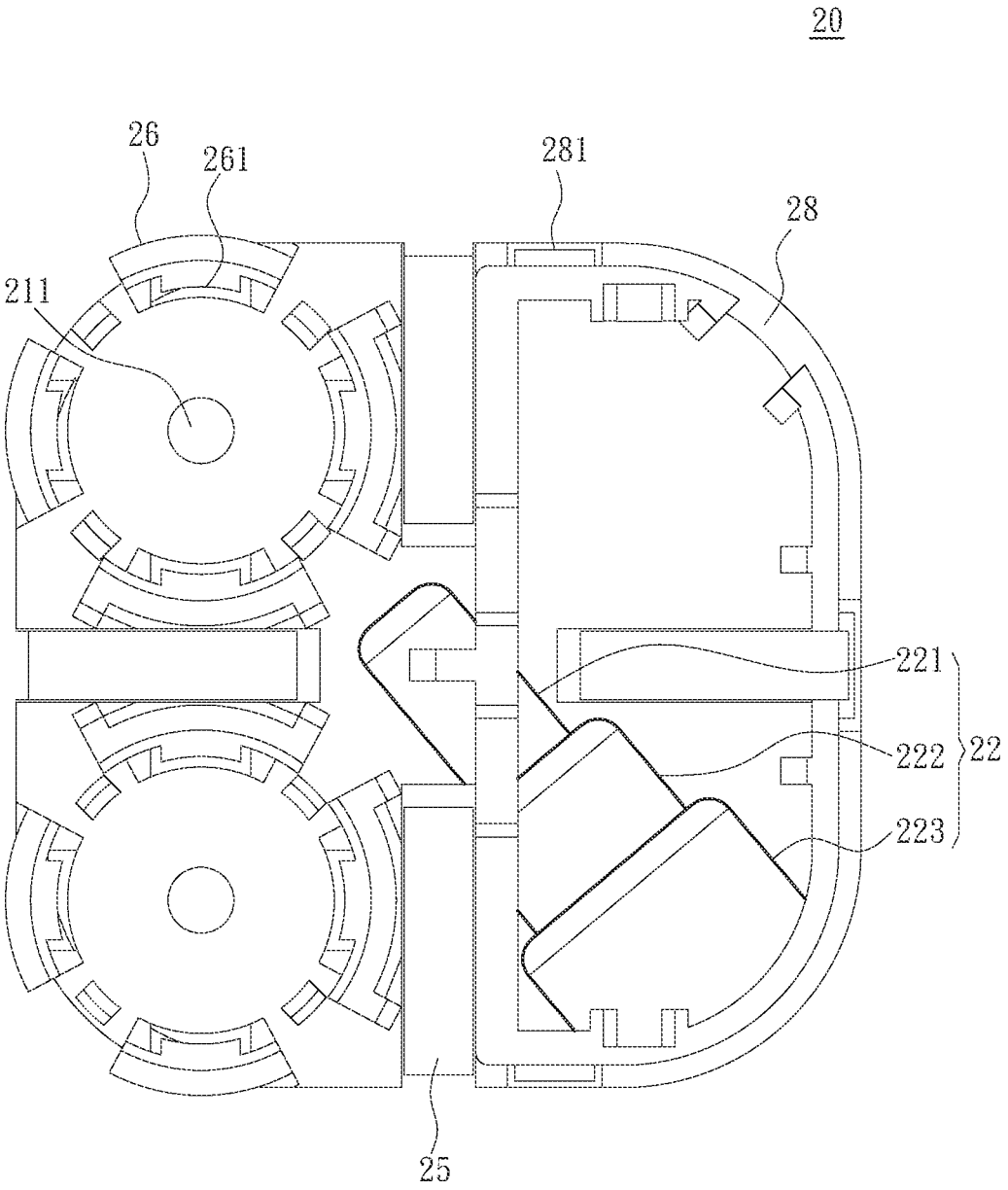
FIG. 4 is a first cross-sectional view of an embodiment of the present invention.
Figure 5:
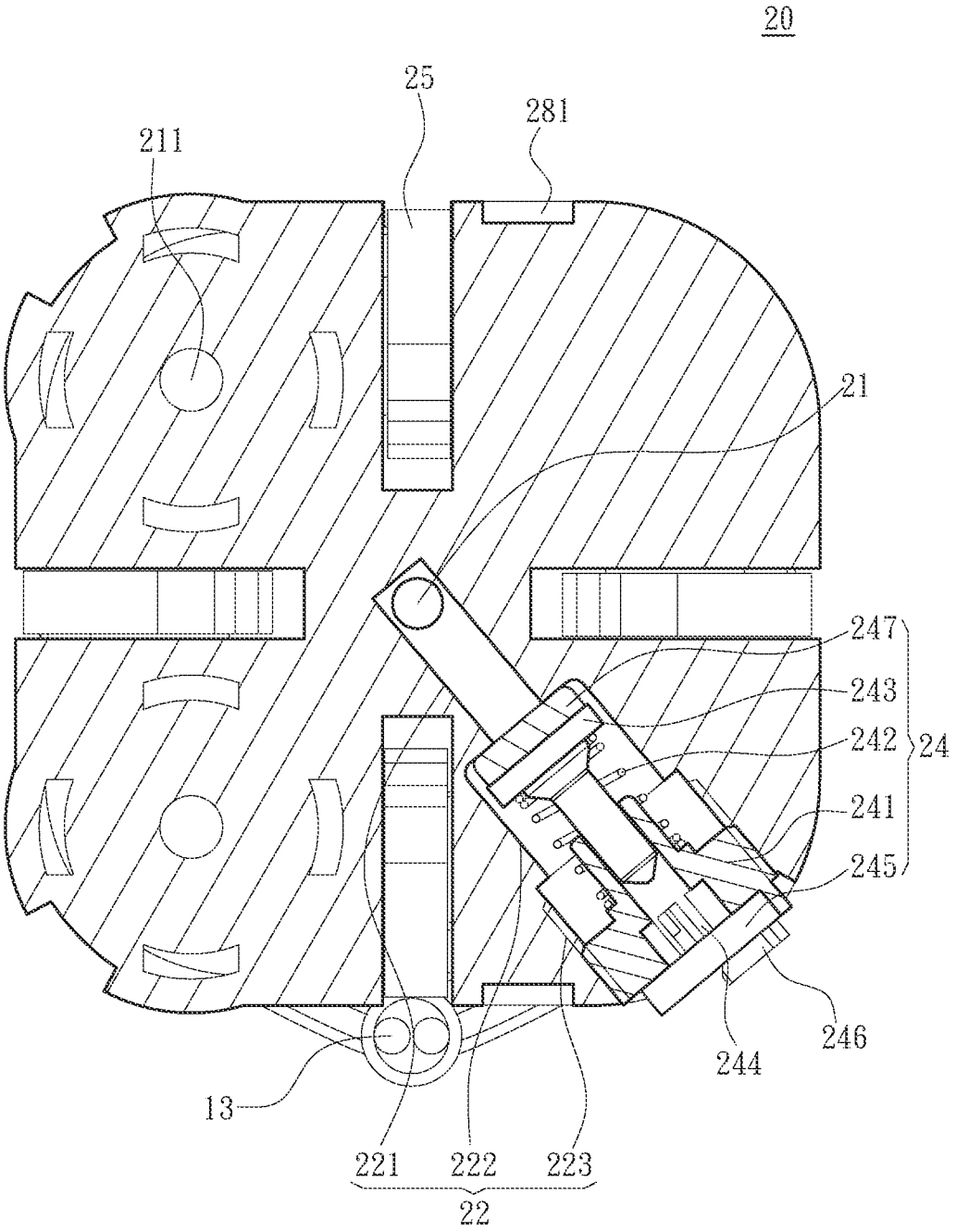
FIG. 5 is a first implementation state view of an embodiment of the present invention.

Referring to FIG. 4 and FIG. 5, in order to describe the pressure relief channel 22 in detail, the pressure relief channel 22 is divided into an arrangement section 221, a movable section 222, and a mounting section 223. In an embodiment, the arrangement section 221, the movable section 222, and the mounting section 223 include different inner diameters separately, wherein the inner diameters in an ascending order is the arrangement section 221, the movable section 222, and the mounting section 223. Further, the pressure relief assembly 24 includes a fixed member 241 provided in the mounting section 223, and a movable member 243 provided in the movable section 222 to abut against the fixed member 241 with an elastic member 242. In order to mount the fixed member 241 on the mounting section 223 for a user conveniently operating the fixed member 241, the fixed member 241 is connected with the mounting section 223 in a screw connection. That is, the user is able to adjust the fixed member 241 in a screwing manner. In addition, two ends of the elastic member 242 abut against the movable member 243 and the fixed member 241, respectively. The elastic member 242 is acted by the fixed member 241, and the elastic member 242 pushes against the movable member 243. Further, the movable member 243 includes a closed position for closing the arrangement section 221, and a pressure relief position for discharging an airflow in the airflow channel 21 from the arrangement section 221 based on the pressure change in the pressure relief channel 22. In other words, an outer diameter of the movable member 243 needs to be greater than the inner diameter of the arrangement section 221 in a development process, so that the movable member 243 is able to completely close the arrangement section 221 and prevent the airflow in the airflow channel 21 from leaking out. In order for the movable member 243 to be placed into the movable section 222, the outer diameter of the movable member 243 needs to be set less than the inner diameter of the mounting section 223 and an inner diameter of the mounting hole 23, so that the movable member 243 is able to enter through the mounting hole 23 during assembly. In an embodiment, the fixed member 241 includes an air vent 244 communicating the mounting section 223 with an outside of the flow passage base 20 to discharge a pressure relief airflow out of the flow passage base 20. Further, the air vent 244 is covered with a ventilation member 245 which is made of a cotton material. In practice, the ventilation member 245 is disposed on the fixed member 241 during assembly, and thus the ventilation member 245 allows the output airflow to be discharged to the outside.

Figure 6:
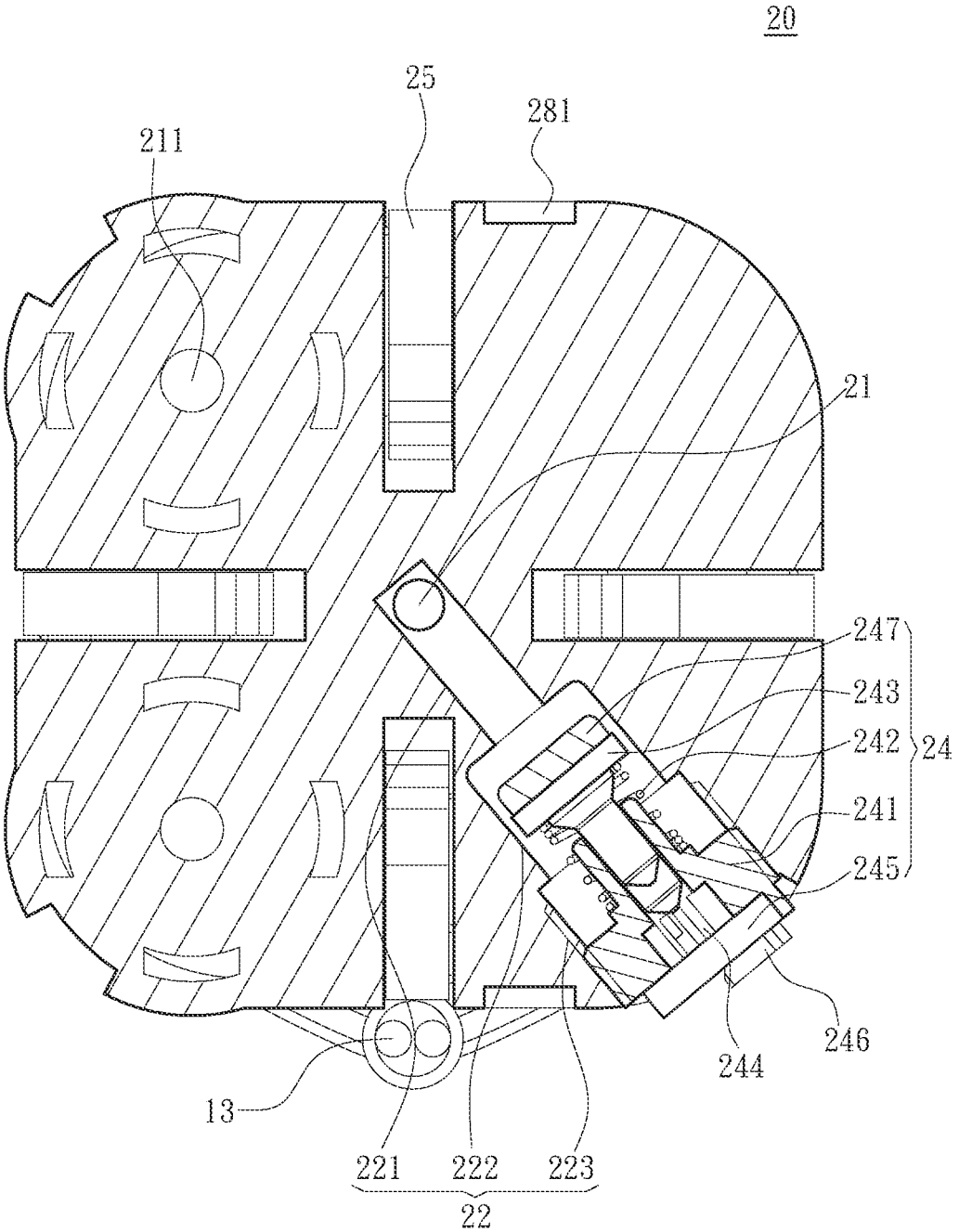
FIG. 6 is a second implementation state view of an embodiment of the present invention.
Figure 7:
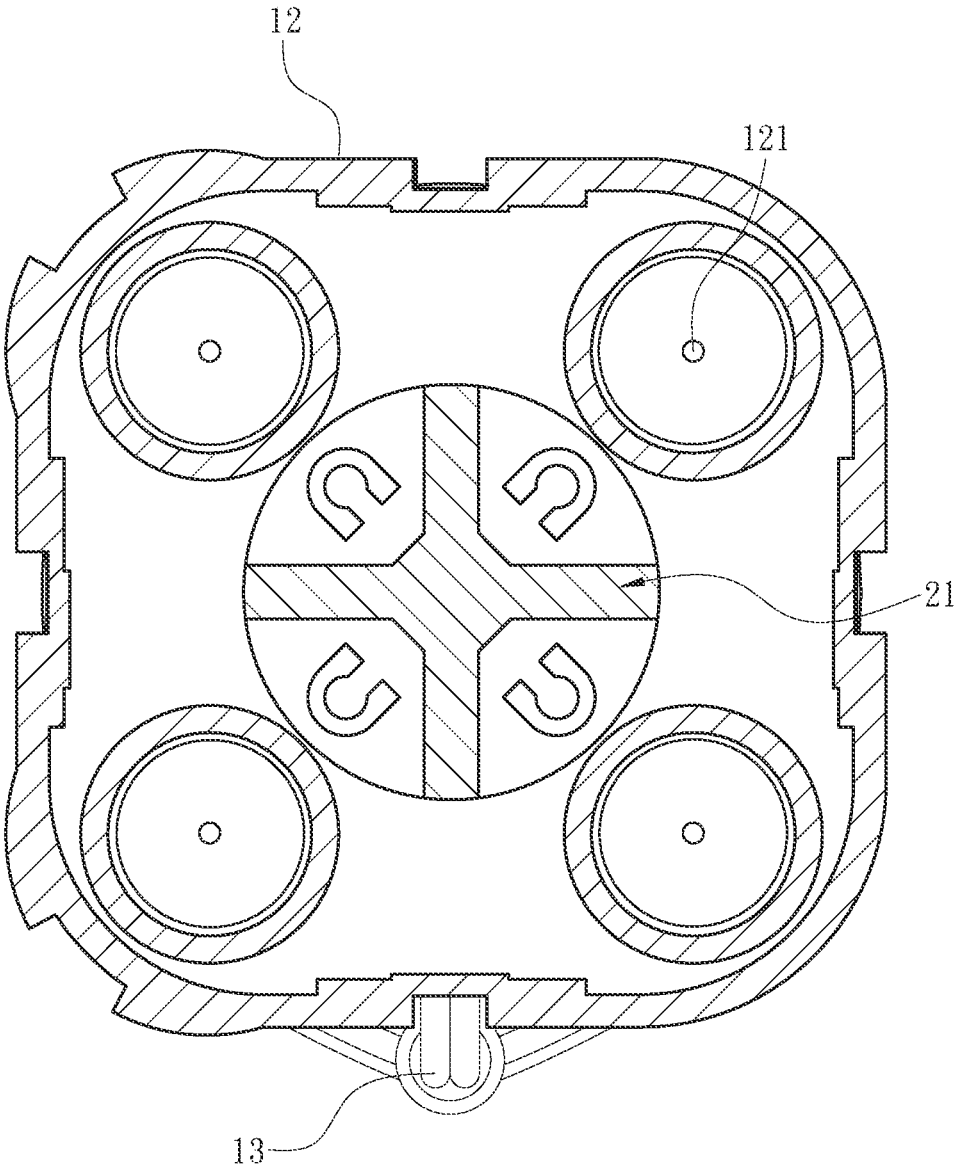
FIG. 7 is a second cross-sectional view of an embodiment of the present invention.

An implementation of the pressure relief assembly 24 will now be described. The movable member 243 is located in the closed position if an airflow pressure of the airflow channel 21 is less than a pushing force of the elastic member 242, as shown in FIG. 5; and the movable member 243 is located in the pressure relief position if the airflow pressure of the airflow channel 21 is greater than or equal to the pushing force of the elastic member 242, as shown in FIG. 6. Specifically, in order to prevent the air pump 100 from over-inflating the to-be-inflated object, the elastic member 242 is acted by the fixed member 241 to limit a pressure of the output airflow based on the degree of tightening of the fixed member 241 screwed on the mounting section 223. That is, the pressure of the output airflow is adjusted by the fixed member 241, and the pressure of the output airflow is not greater than a pushing force exerted by the elastic member 242 on the movable member 243. In other words, a maximum value of the pressure of the output airflow is determined by the degree of compressed the elastic member 242, and the degree of compressed the elastic member 242 is determined by a force that the fixed member 241 provided on the elastic member 242. Accordingly, the force that the fixed member 241 provided on the elastic member 242 is first adjusted, and the output airflow is generated by the driving motor 11 and the air bag set 12, and the output airflow is output to the pressure relief channel 22 along the airflow channel 21. If a value of a pressure of the output airflow is less than the pushing force that the elastic member 242 applied to the movable member 243, the movable member 243 is located in the closed position, and thus the arrangement section 221 is closed so that the output airflow is discharged from the airflow outlet 211 only. Thereafter, the air pump 100 operates continuously to increase the pressure of the output airflow. Once the value of the pressure of the output airflow is greater than the pushing force that the elastic member 242 applied to the movable member 243, the movable member 243 is displaced from the closed position in a direction opposite to the arrangement section 221 to the pressure relief position. That is, the arrangement section 221 is changed from closed to open, and part of the output airflow passes through the arrangement section 221 and is discharged from the mounting hole 23 to the outside of the flow passage base 20, so that the pressure of the output airflow is reduced. Then, once the value of the pressure of the output airflow drops below the pushing force that the elastic member 242 applied to the movable member 243, the movable member 243 returns to the closed position.

Accordingly, the fixed member 241 is provided on the mounting hole 23 for the user easily operates and adjusts the fixed member 241, such as adjusting the force that the fixed member 241 provided on the elastic member 242 to determine the pushing force that the elastic member 242 on the movable member 243, so as to adjust the pressure of the output airflow. Compared with conventional air pumps, the air pump 100 of the invention is provided with the pressure relief channel 22, which extends towards the sidewall surface, so that the pressure relief assembly 24 is exposed on the air pump 100. Therefore, the air pump 100 is able to assemble with different to-be-inflated objects, and assembly personnel can easily adjust pressures of the air pump 100 to correspond to different pressures required by different to-be-inflated objects during assembly.

In an embodiment, referring to FIG. 5 and FIG. 6, in order to close the arrangement section 221 securely and prevent the output airflow from leaking out as the movable member 243 is located in the closed position, the pressure relief assembly 24 further includes an air lock 247 disposed between the movable member 243 and the arrangement section 221 to prevent the outlet airflow from passing through. An outer diameter of the air lock 247 is greater than the inner diameter of the arrangement section 221 and less than the inner diameter of the mounting section 223, so that the air lock 247 can be placed into the movable section 222 while the air lock 247 seals the arrangement section 221. That is, assembly personnel must first place the air lock 247 in the movable section 222 to close the arrangement section 221 during assembly, and then place the movable member 243 therein to complete the assembly. Furthermore, when the movable member 243 is displaced to the pressure relief position due to the pressure of the output airflow, the air lock 247 is also displaced in the direction opposite to the arrangement section 221 due to the pressures of the output airflow. After the pressure of the output airflow is reduced, the air lock 247 returns along with the movable member 243 to close the arrangement section 221 again.

In an embodiment, referring to FIG. 2 and FIG. 3, the fixed member 241 further includes at least one limit arm 246 for assembly personnel to secure the ventilation member 245 during assembly, in order to precisely cover the ventilation member 245 on the air vent 244 and to prevent the ventilation member 245 from falling out during the implementation process.

In an embodiment, referring to FIG. 1, the flow passage base 20 includes at least one fastening member 25 to enhance the connection strength between the flow passage base 20 and the air pump body 10, and preventing the flow passage base 20 from being separated with the air pump body 10 due to the vibration generated by the air pump 100.

Figure 8:
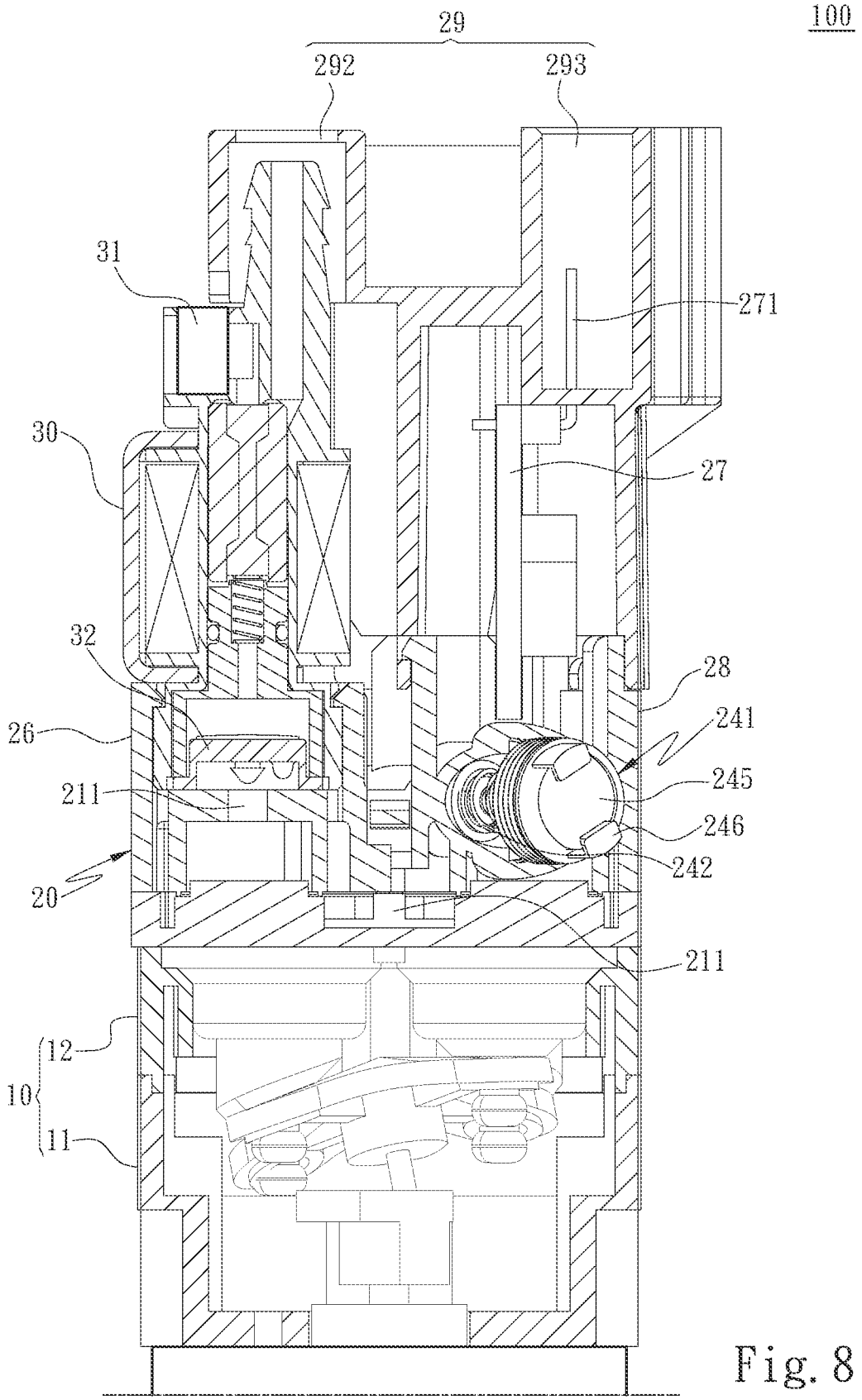
FIG. 8 is a third cross-sectional view of an embodiment of the present invention.

Further, referring to FIG. 1, FIG. 2 and FIG. 3, the flow passage base 20 includes a first arrangement part 26 for accommodating the at least one the air valve 30. The first arrangement part 26 is positioned at the airflow outlet 211, so that the at least one air valve 30 is arranged on the first arrangement part 26 to receive the output airflow from the airflow outlet 211. More specifically, the at least one air valve 30 is provided on the first arrangement part 26 in a clamping manner, so that the assembly personnel can easily assemble the at least one air valve 30 on the first arrangement part 26. In addition, when the at least one air valve 30 needs to be repaired and replaced, a maintenance technician can easily replace the at least one air valve 30. Referring to FIG. 8, the at least one air valve 30 further includes a noise reduction member 31. When the air pump 100 is deflated, the direction of airflow in the air pump 100 is changed by the noise reduction member 31 so as to buffer the airflow and reduce the noise generated by the airflow.

The at least one air valve 30 further includes a back pressure valve 32 which prevents the output airflow from flowing back when the at least one air valve 30 inflates the to-be-inflated object. Further, the back pressure valve 32 is connected to the at least one air valve 30 and is arranged in a clamping connection with the first arrangement part 26. The first arrangement part 26 includes a limited block 261, and the back pressure valve 32 is provided with a limited hole 321 corresponding to the limited block 261. When the at least one air valve 30 is arranged on the first arrangement part 26 during assembly, the limited block 261 is inserted into the limited hole 321 to limit the at least one air valve 30 and prevent the at least one air valve 30 from being separated with the first arrangement part 26. In one embodiment, a number of the at least one air valves 30 is two as shown in drawings; the number of which is adjusted according to requirements not limited thereto.

Referring to FIG. 2, in an embodiment, an electric wire 13 is provided on the air pump body 10, and the flow passage base 20 further includes a control circuit board 27 to provide electric signals to the driving motor 11 and the air valve 30. That is, the electric wire 13 supplies an electric power to the driving motor 11 to enable the driving motor 11 operation. Besides, the driving motor 11 and the at least one air valve 30 receive the electrical signals from the control circuit board 27 to determine opening and closing of the driving motor 11 and the at least one air valve 30. In detail, the control circuit board 27 includes at least one electrical pin 271 connected to a port for receiving electrical control signals transmitted from the port. Furthermore, in order to assemble the control circuit board 27 on the flow passage base 20 stably, the flow passage base 20 includes a second arrangement part 28 for accommodating the control circuit board 27. Specifically, the second arrangement part 28 is provided facing to the first arrangement part 26.

Referring to FIG. 2, in an embodiment, in order to protect the air valve 30 and the control circuit board 27, the flow passage base 20 further includes a cover body 29 covering the at least one air valve 30 and the control circuit board 27. The purpose of the cover body 29 is to prevent the air valve 30 and the control circuit board 27 from subjecting to a force to be broken. Further, since the at least one air valve 30 is exposed when the at least one air valve 30 is mounted on the flow passage base 20, that is, two sides of the at least one air valve 30 are without any protection structure, the cover body 29 further includes a plurality of support plates 291 which are provided on the two sides of the at least one air valve 30 to prevent the at least one air valve 30 from being collided, and to further limit the at least one air valve 30 to be displaced by the vibration generated from the air pump 100. In order for the at least one air valve 30 to inflate the to-be-inflated object, and to facilitate wiring of the control circuit board 27, the cover body 29 is further provided with at least one output hole 292 for assembling with the at least one air valve 30, and a wiring hole 293 for assembling with the control circuit board 27. The cover body 29 is provided with the output hole 292 for the purpose of protecting an outlet nozzle of the at least one air valve 30 from being broken. Furthermore, types of the output hole 292 and the wiring hole 293 only need to meet a demand that the at least one air valve 30 inflating the to-be-inflated object and a purpose of facilitating the wiring of the control circuit board 27, and not limited by the types shown in the drawings. In an embodiment, in order to prevent the cover body 29 from falling off the flow passage base 20, the cover body 29 is placed on the flow passage base 20 during assembly. In another embodiment, the second arrangement part 28 includes an assembly protrusion 281, and the cover body 29 includes an assembly hole 294 corresponding to the assembly protrusion 281. That is, when the cover body 29 is mounted on the flow passage base 20, the assembly protrusion 281 is inserted into the assembly hole 294. In addition, positions of the assembly hole 294 and the assembly protrusion 281 are not limited to the drawings.

What is claimed is:

1. An air pump with an external pressure relief valve, comprising:

an air pump body, comprising a driving motor and at least one air bag set actuated by the driving motor to generate an output airflow;

a flow passage base, arranged on the air pump body, the flow passage base comprising an airflow channel and a pressure relief channel, the airflow channel receiving the output airflow of the air bag set and provided with at least two airflow outlets, the pressure relief channel communicated with a central of the airflow channel and extending to any sidewall surface of the flow passage base, wherein a mounting hole is formed on the sidewall surface to communicate with the pressure relief channel, and a pressure relief assembly is placed into the pressure relief channel through the mounting hole, wherein from the airflow channel to the mounting hole, the pressure relief channel includes an arrangement section, a movable section, and a mounting section with different inner diameters separately, and wherein the inner diameters in an ascending order is the arrangement section, the movable section, and the mounting section; and at least two air valves, arranged on the flow passage base and respectively communicated with the at least two airflow outlets to receive the output airflow;

wherein the flow passage base includes at least one first arrangement socket positioned at one of the at least two airflow outlets to accommodate one of the at least two air valves.

2. The air pump with the external pressure relief valve according to claim 1, wherein the flow passage base includes a control circuit board to provide electric signals to the driving motor and the at least two air valves, and a second arrangement socket to accommodate the control circuit board.

3. The air pump with the external pressure relief valve according to claim 2, wherein the flow passage base includes a cover body covering the at least two air valves and the control circuit board, and the cover body is provided with at least one output hole assembling with one of the at least two air valves and a wiring hole assembling with the control circuit board.

4. The air pump with the external pressure relief valve according to claim 1, wherein the pressure relief assembly comprises a fixed member provided in the mounting section and a movable member provided in the movable section to abut against the fixed member with an elastic member, and an outer diameter of the movable member is greater than the inner diameter of the arrangement section and less than the inner diameter of the mounting section, and wherein based on the elastic member subjected to a pressure change in the pressure relief channel, the movable member includes a closed position for closing the arrangement section, and a pressure relief position for discharging an airflow in the airflow channel from the arrangement section to outside the mounting hole.

5. The air pump with the external pressure relief valve according to claim 4, wherein an air lock is disposed between the movable member and the arrangement section for to prevent the output airflow from passing through.

6. The air pump with the external pressure relief valve according to claim 5, wherein the fixed member includes an air vent communicating the mounting section with outside to discharge a pressure relief airflow out.

* * * * *